US005129337A

United States Patent [19]

Humphreys

[11] Patent Number: 5,129,337

[45] Date of Patent: Jul. 14, 1992

[54] APPARATUS FOR LOADING A LINE CLOSING MACHINE

[75] Inventor: John C. Humphreys, Hinckley, England

[73] Assignee: H. Flude & Co. (Hinckley) Limited, Leicestershire, England

[21] Appl. No.: 634,870

[22] PCT Filed: May 3, 1990

[86] PCT No.: PCT/GB90/00684

§ 371 Date: Jan. 24, 1991

§ 102(e) Date: Jan. 24, 1991

[87] PCT Pub. No.: WO90/13697

PCT Pub. Date: Nov. 15, 1990

[51] Int. Cl.[5] ..... D05B 33/00

[52] U.S. Cl. ..... 112/121.15

[58] Field of Search ..... 112/303, 305, 309, 121.26, 112/121.15, 121.12, 121.29, 262.2; 223/75, 77

[56] References Cited

U.S. PATENT DOCUMENTS 3,777,681 12/1973 Horita ..... 112/262.2 X
4,188,898 2/1980 Bell, Jr. et al. ..... 112/121.15 X
4,364,320 12/1982 Nakhle et al. ..... 112/262.2
4,444,140 4/1984 Moyer ..... 112/121.29 X
4,539,924 9/1985 Bell, Jr. et al. ..... 112/262.2
4,620,494 11/1986 Takatori et al. ..... 112/121.15
4,628,844 12/1986 Hodges ..... 112/121.15
4,784,070 11/1988 Thurner et al. ..... 112/121.15 X

FOREIGN PATENT DOCUMENTS 0306460 3/1989 European Pat. Off. .
2081316 2/1982 United Kingdom .

*Primary Examiner*—Werner H. Schroeder
*Assistant Examiner*—Paul C. Lewis
*Attorney, Agent, or Firm*—Longacre & White

[57] ABSTRACT

An apparatus for loading a line closing machine with pairs of stockings. The apparatus includes a pair of cooperating fingers mounted on the end of a carousel transfer arm. Pairs of stockings are loaded onto the fingers so as to stretch the open ends of the stockings between the fingers. The carousel advances the fingers towards a line closing machine and the fingers orient the open ends of the stockings in a horizontal vertically spaced manner so as to accept a pair of stocking supports on the line closing machine. The fingers then pivot so as to release the pair of stockings onto the stocking supports of the line closing machine.

17 Claims, 5 Drawing Sheets

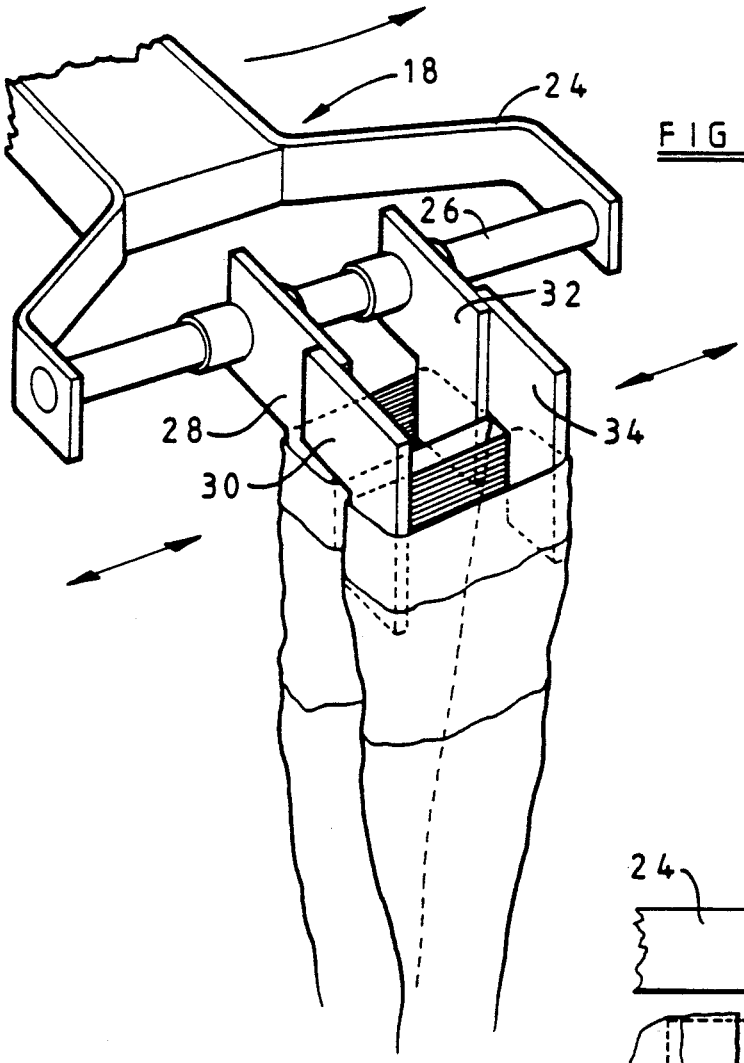
FIG 5
FIG 6
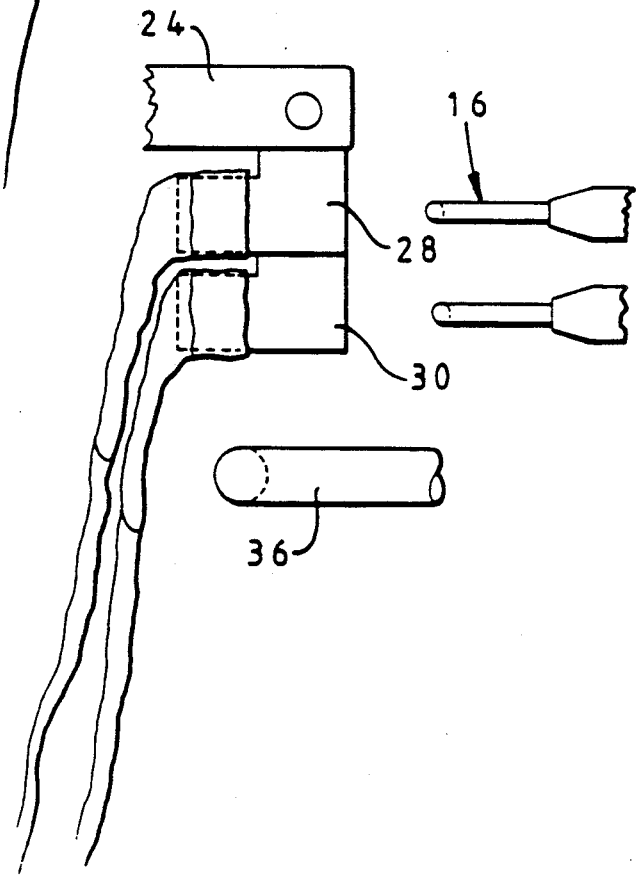

APPARATUS FOR LOADING A LINE CLOSING MACHINE

The present invention relates to an apparatus for loading a line closing machine.

In the hosiery industry, much of the production of panti-hose uses a line closing machine such as a Takatori Line Closer. Hitherto, such line closing machines are loaded manually with two stockings which are to be seamed into a pair of panti-hose.

The present invention seeks to provide an apparatus for loading a line closing machine with stockings to be seamed into a pair of panti-hose.

Accordingly, the present provides an apparatus for loading a line closing machine, the apparatus comprising a carousel unit having a plurality of transfer arm means, the carousel unit being rotatable to move said transfer arm means successively through a loading station and at least one transfer station; and wherein each said transfer arm means has support means for supporting a pair of stockings, said support means being movable between a first position enabling engagement of supporting means of said line closing machine with said stockings and a second position to allow said supporting means to disengage said stockings from said support means.

The present invention is further described hereinafter, by way of example, with reference to the accompanying drawings, in which.

Figure 2:
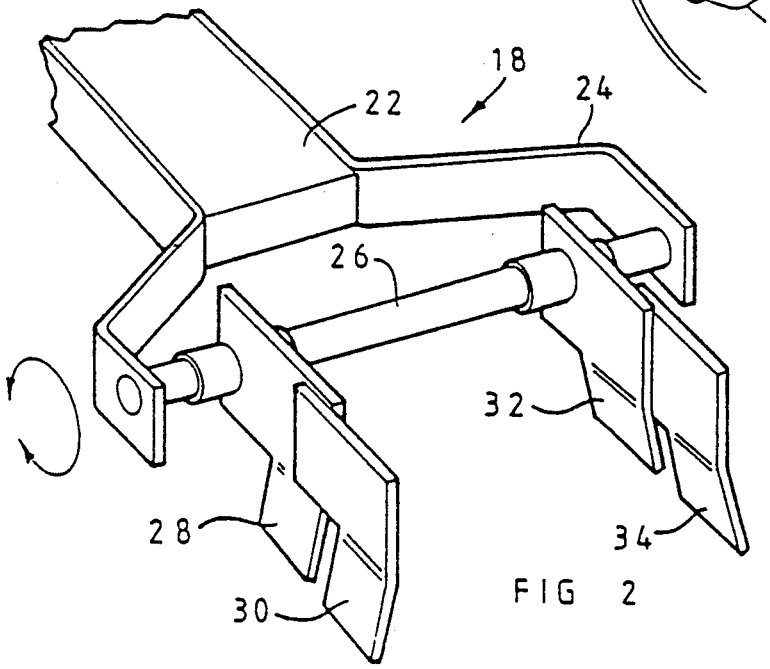
FIG. 2 is a perspective view of a transfer arm of the apparatus of FIG. 1.
Figure 3A:
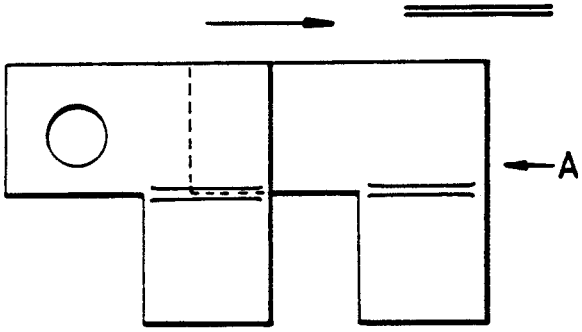
Figure 3B:
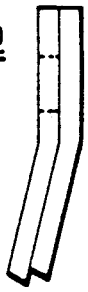

FIG. 3*a* is a side elevation of a pair of fingers of the arms of FIG. 2 in an extended position;

FIG. 3*b* is an end elevation of the fingers of FIG. 3*a* as seen in the direction of arrow A of FIG. 3*a;*

Figure 3C:
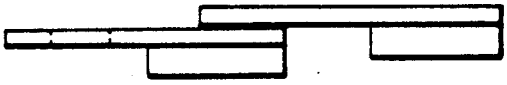

FIG. 3*c* is a plan view of the fingers of FIG. 3*a;*

Figure 1:
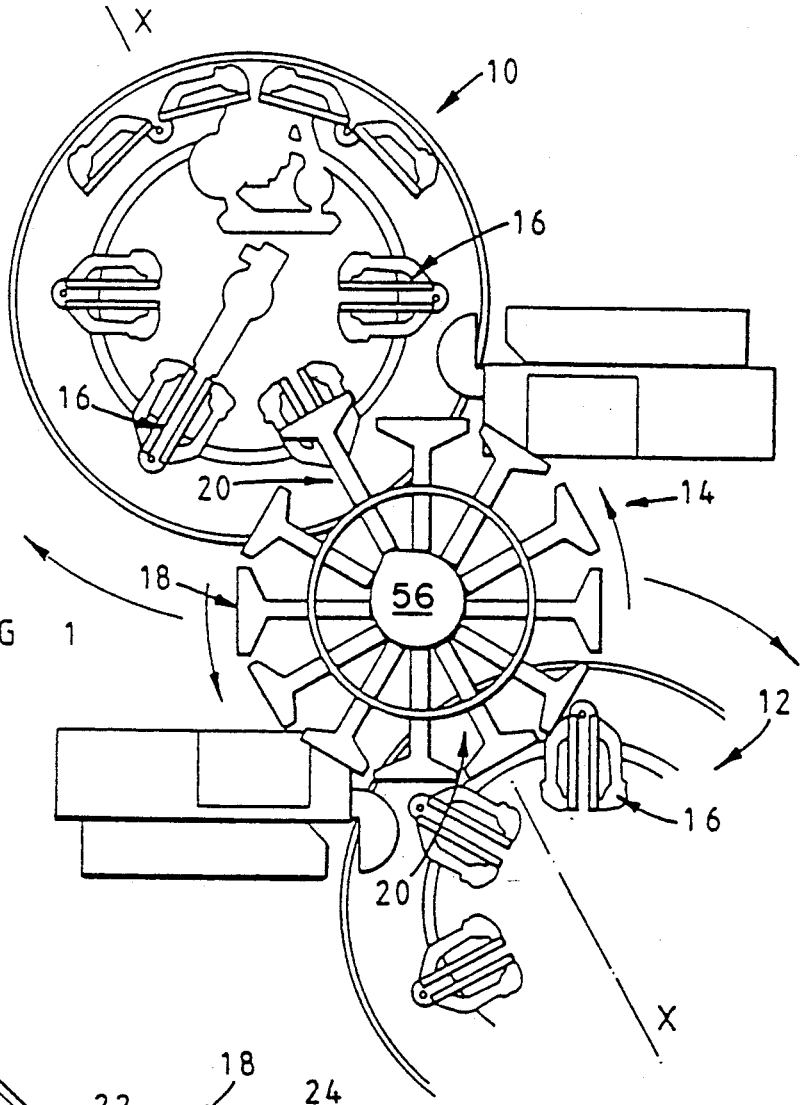
FIG. 1 is a plan view of two known line closing machines with a preferred embodiment of the present invention shown in outline.
Figure 4A:
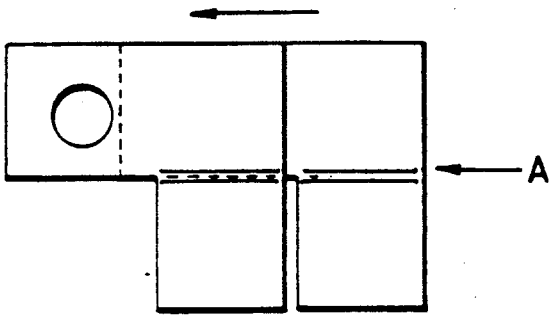
Figure 4B:
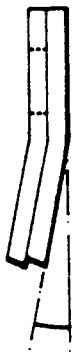
Figure 4C:
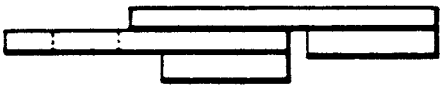
Figure 7:
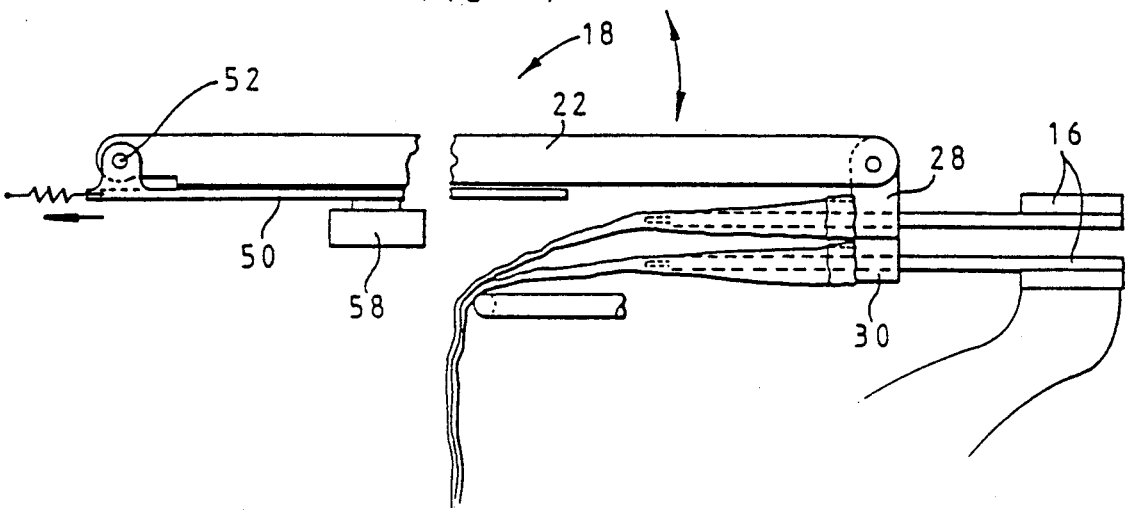
Figure 8:
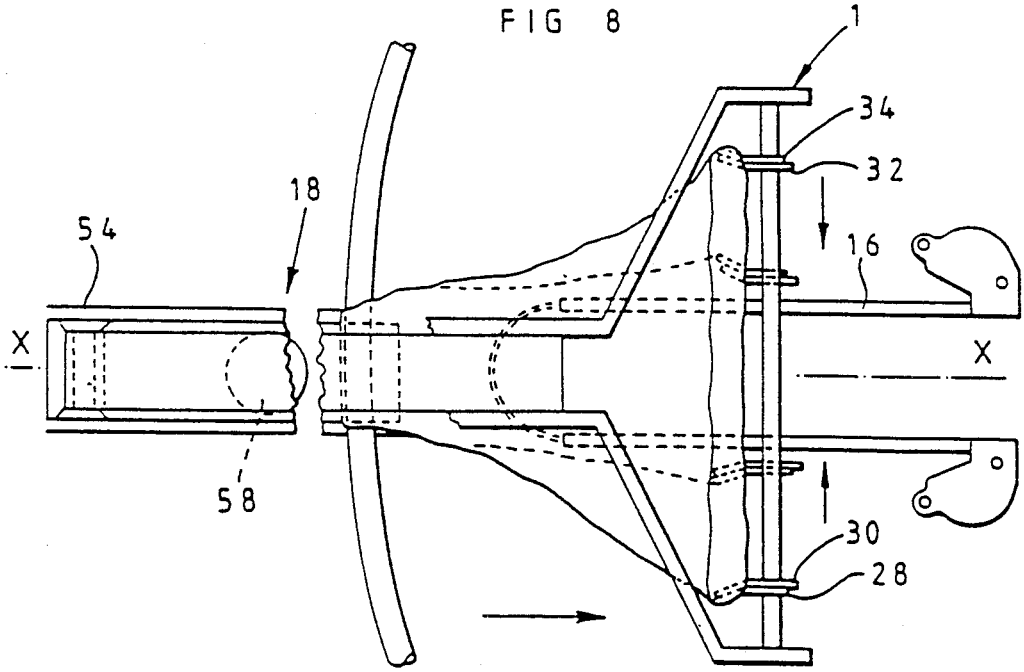
Figure 9:
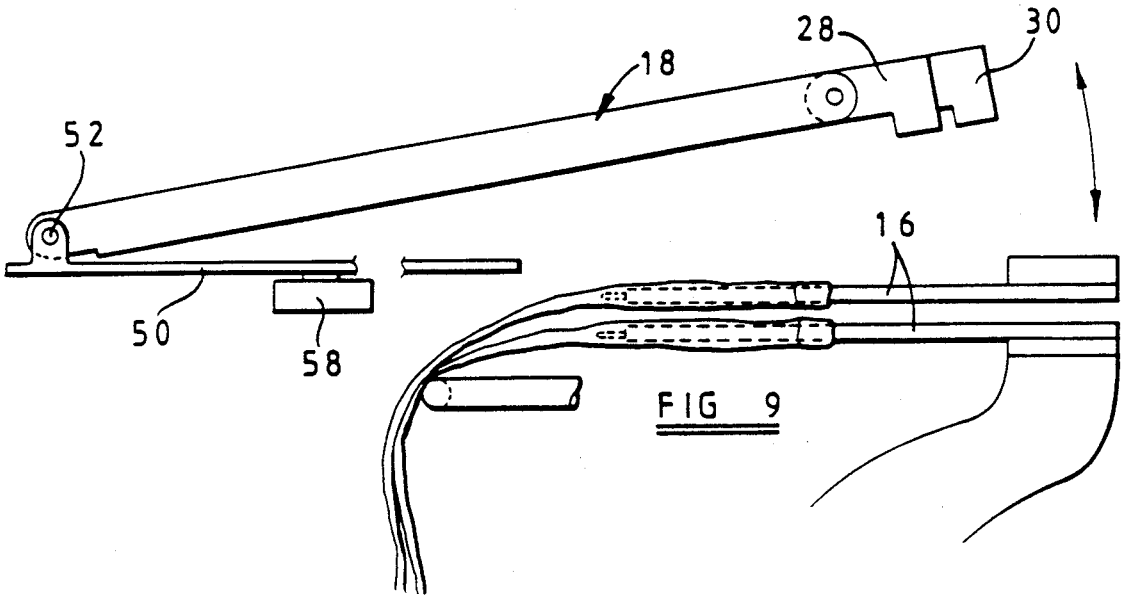
Figure 10:
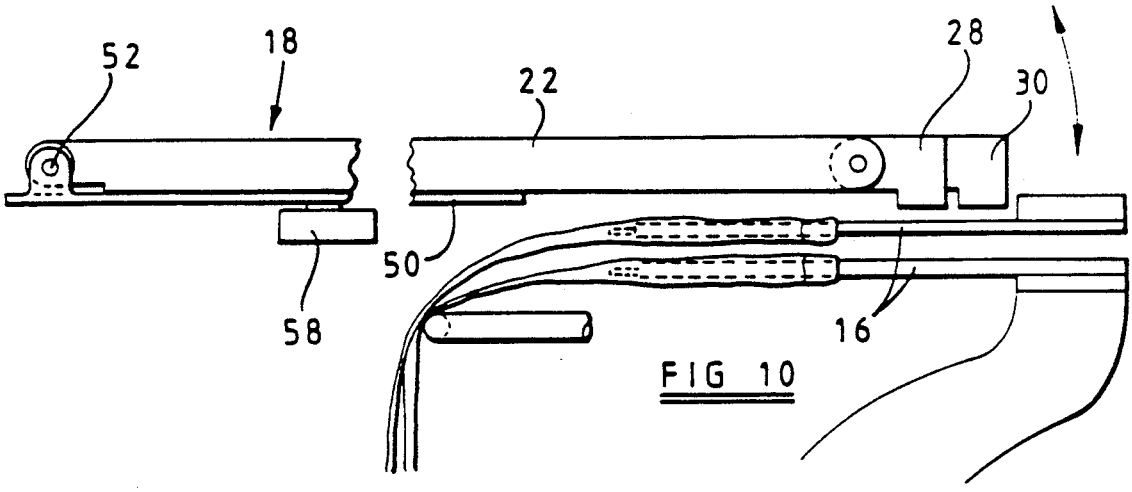
Figure 11:
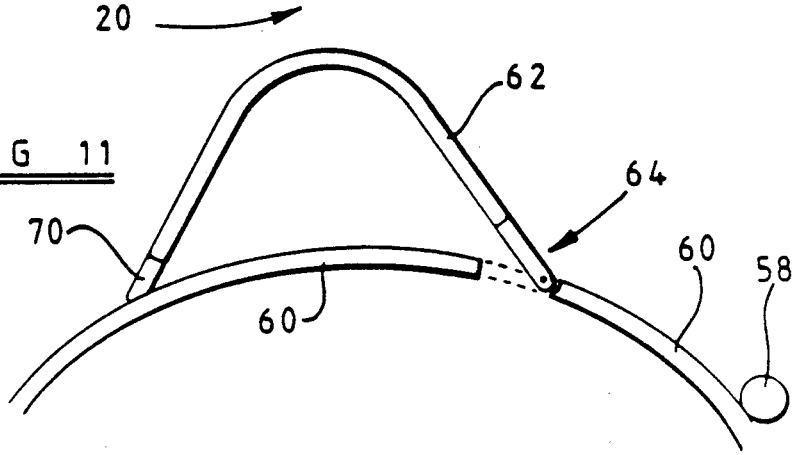

FIGS. 4*a*, 4*b* and 4*c* are views similar to those of FIGS. 3*a*, 3*b* and 3*c* showing the pair of fingers in a retracted position;

FIG. 5 is a perspective view of the arm of FIG. 2 in a loading position;

FIG. 6 is a side elevation of the transfer arm prior to engagement with supporting arms of a line closing machine;

FIG. 7 is a view similar to that of FIG. 6 showing the supporting arms engaged in the stockings on the arm;

FIG. 8 is a plan view of the arrangement of FIG. 7;

FIGS. 9 and 10 are view similar to that of FIG. 7 showing subsequent operating positions of the supporting arms; and FIG. 11 is a plan view of a portion of a cam track of the apparatus at a transfer station Referring to the drawings, FIG. 1 shows two line closing machines 10, 12 with a preferred form of loading apparatus 14 according to the present invention positioned in alignment with and between the two line closing machines. Such line closing machines are well known and do not form part of this invention. Each line closing machine has six pairs of supporting arms 16 and the machines are arranged to rotate in the same direction (clockwise as seen in FIG. 1), 30 degrees out of phase, such that the pairs of supporting arms of the two machines alternately present themselves to the loading apparatus to enable transfer of pairs of stockings from transfer arms 18 of the loading apparatus to supporting arms of the line closing machines at transfer stations 20. To this end, the loading apparatus is provided with twelve equally angularly spaced transfer arms 18, a first set (six) of these (every alternate one) cooperating with one of the line closing machines and a second set (the other six) cooperating with the other line closing machine.

The loading apparatus 14 rotates in an anti-clockwise direction and as each alternate transfer arm 18 of those cooperating with the line closing machine 10 passes through a transfer station 20 the transfer arm is extended to enable transfer of the stockings. The extension of the transfer arms can be effected by suitable means such as fixed cams which act on a camming surface on each of the arms (described further below).

FIG. 2 shows a free end of a transfer arm of the loading apparatus, the arm having an elongate support member 22 which carries at its outer end a generally U-shaped bracket 24. The outer ends of the limbs of the U are joined by a shaft 26 on which are supported two pairs of support fingers 28, 30 and 32, 34. The pairs of fingers are slidable on the shaft 26 towards and away from each other and can also be pivoted from a generally horizontal attitude as shown in FIG. 2, downwardly through 90 degrees to a generally vertical attitude.

In addition, the fingers of each pair are movable relative to one another between a retracted position as shown in FIG. 4 and an extended position as shown in FIG. 3. As can be seen in FIGS. 3*b* and 4*b* the fingers are generally planar in shape and each finger has an upper portion which lies in a generally vertical plane and a lower portion which is angled outwardly at an angle 36 of typically 15 degrees.

Movement of the fingers towards and away from one another may be controlled by a simple piston/cylinder arrangement. Pivotal movement of fingers may also be controlled by a simple piston/cylinder arrangement or other suitable arrangement.

In use, an operator at a loading station loads two stockings for forming a pair of panti-hose onto the transfer arm fingers, one stocking being stretched across the fingers 28, 32 and the other stocking being stretched across the fingers 30, 34. The fact that the lower portions of the fingers are angled outwardly help to retain the stockings on the fingers, the fingers being spaced sufficiently far apart so as to retain each stocking on the fingers by virtue of the elasticity of the waistband of each stocking. During loading the fingers 28, 30 and 32, 34 of each pair are in their extended positions (FIG. 3*a*) to facilitate loading.

As the loading apparatus rotates, the two pairs of fingers 28, 30 and 32, 34 are displaced further apart along the shaft 26 to stretch further the waistbands of the two stockings. As movement of the transfer arm continues towards the cooperating line closing machine the fingers of each pair are retracted into the position shown in FIG. 4*a* and are also pivoted about the shaft 26 into the position shown in FIG. 6. FIG. 6 shows that as the transfer arm moves towards the associated transfer station 20 it moves towards a guide rail 36 of the line closing machine and a cooperating pair of supporting arms 16 of the line closing machine. The support member 22 of the transfer arm 18 is pivotally mounted at or adjacent its end remote from the fingers 28 to 34 to an elongate slide 50 by means of a generally horizontal pivot 52. This allows the support member 22 to pivot in a generally vertical plane from the generally horizontal attitude shown in FIG. 7 to the raised position shown in FIG. 9.

The slide 50 is guided for axial sliding movement in a guide 54 so as to move the support member 22 along its axis, radially of the apparatus 14 between a retracted position and the extended position shown in FIG. 9. Axial movement of the slide 50 and therefore of the support member 22 is effected by means of a cam 56 which acts on a cam follower 58 secured to the underside of the slide 50. The slider 50 and support member 22 are biased into the retracted position by suitable resilient means (not shown) such as a coil spring.

As the transfer arm 18 moves towards the transfer station 20 the cam follower 58 moves along a cam track 60 which extends along a generally circular path. As the arm 18 moves into the transfer station 20 the cam follower 58 is diverted from the generally circular path onto a further cam track 62 by a switch cam 64. The cam track 62 extends outwardly of the circular path, then generally parallel, and then back towards the circular path so that as the transfer arm 18 moves into the transfer station the cam follower 58 follows the cam 62 to extend the support member 22. The size of the fingers 28 to 34 and the spacing of the pairs of fingers are such as to allow the supporting arms 16 to penetrate into the stockings as can be seen in FIG. 7, when the transfer arm 18 moves into the transfer station 20. At this point the pairs of fingers are moved towards one another, as shown in FIG. 8 to a position as close as possible to the supporting arms 16 without actually contacting the latter. The extension of the support member 22 as the transfer arm moves into the transfer station causes the supporting arms 16 of the line closing machine to penetrate well into the stockings. As the transfer arm 18 approaches or reaches its outermost position the pairs of fingers 28, 30 and 32, 34 are pivoted upwards into the position shown in FIG. 4. Since the stockings are prevented from moving with the fingers by the supporting arms 16, the result is that the stockings are drawn from the fingers and retained on the supporting arms 16.

As the line closing machine 10 and the loading apparatus 14 continue to rotate the slider 30 and the support member 22 may be raised into the position shown in FIG. 9. This is to ensure that the transfer arm 18 does not risk fouling any attachments which may be fitted either to the line closing machine or the loading apparatus. At the same time, the cam follower 58 follows the trailing portion of the cam 62 to allow the transfer arm to retract. Once the transfer arm has passed out of the transfer station 20 the arm is lowered into its horizontal position If, for whatever reason, a transfer arm is not loaded with a pair of stockings then it is desirable that the associated support member and slide should not be extended at the transfer station. To this end, the cam 60 is continued along the generally circular path through the transfer station but is provided adjacent the leading end of the cam 62 with a cam switch 64 which is pivotable between a first position shown in dotted lines in FIG. 11 and second position shown in solid lines.

When the cam switch 64 is in its second position it guides the cam follower 58 around the outer cam 62. However, when the cam switch 64 is in its first position the cam follower 58 is allowed to continue along the generally circular path of the cam 60. The downstream end portion 70 of the cam 62 is pivoted on the cam 62 such that it pivots out of the way when contacted by a cam follower 58 travelling inside the cam 62 to allow the cam follower to pass. The end portion 70, however, provides support for a cam follower 58 passing on the outside of the cam 62 since its free end rests on the cam 60.

Actuation of the cam switch 64 may be effected by any suitable means, for example by an electric motor or solenoid, whilst the presence or absence of stockings on the transfer arm 18 may be monitored by any suitable means such as a light sensor which receives a beam of light which is interrupted by the presence of stockings, the signal from the sensor controlling actuation of the cam switch 64. In addition, the cam switch 64 and the corresponding cam switch at the two transfer stations are controlled to cause the first set of transfer arms 18 to extend at one of the transfer stations and the second set of transfer arms 18 to extend at the other transfer station so that the stockings on each alternate transfer arm are transferred at one station and the remaining stockings are transferred at the other station.

I claim:

1. Apparatus for loading a line closing machine having a plurality of pairs of stocking support means for engaging and supporting open ends of pairs of stockings in a horizontal vertically spaced orientation, the apparatus for loading comprising:

a carousel unit (14) comprising a plurality of transfer arms means (18), the carousel unit being rotatable to move said transfer arm means successively through a loading station where successive pairs of stockings are loaded onto said transfer arms means and at least one transfer station (20) where said pairs of stockings are removed from said transfer arm means, and wherein each said transfer arms means has first support means for supporting a pair of stockings on an end of said transfer arm means, and means for moving said first support means between a first position for engaging said pairs of stockings onto a second supporting means for said pairs of stockings (16) on said line closing machine (10, 17), and a second position for allowing said second supporting means to disengage said pairs of stockings from said first support means, said first support means comprising a pair of spaced apart finger means for engaging said open ends of said pairs of stocking means for pivoting said finger means about an axis to orient in said first and second positions, said first position orienting said pair of finger means to place said open ends of said stockings in a horizontal and vertically spaced position to engage said open ends on said second supporting means.

2. Apparatus as claimed in claim 1 wherein said finger means are pivotable between said first and second positions through an angle of at least 45 degrees

3. Apparatus as claimed in claim 2 wherein said finger means are pivotable through an angle of at least 90 degrees.

4. Apparatus as claimed in claim 1 further comprising means for adjusting the spacing between said finger means.

5. Apparatus as claimed in claim 4 wherein said adjusting means operates to move said finger means towards and away from one another between a first, extended position wherein the spacing between the finger means is such that the stockings are retained on the finger means by the elasticity of the stockings, and a second, retracted position to facilitate withdrawal of the stockings from the finger means during movement of said finger means between said first and second positions.

6. Apparatus as claimed in claim 1 wherein each said finger means comprises first and second spaced apart fingers, the pair of first fingers (28, 32) and the pair of second fingers (30, 34) providing support for a respective one of said stockings.

7. Apparatus as claimed in claim 6 wherein one of said pairs of fingers (28, 32; 30, 34) is movable in unison towards and away from the other of said pairs of fingers to facilitate loading of each said pair of fingers with a respective stocking by an operator at the loading station.

8. Apparatus as claimed in claim 1 further comprising extension means (58, 62) for enabling extension of each said transfer arm means (18) as said transfer arm means moves into said transfer station (20) for facilitating engagement of said supporting means (16) of said line closing machine (10, 12) into said stockings.

9. Apparatus as claimed in claim 8 wherein said extension means comprises cam means (58, 62) on said transfer arm means (18) and said carousel unit (14).

10. Apparatus as claimed in claim 9 wherein said cam means comprises a cam follower (58) on one of said transfer arm means (!8) and said carousel unit (14) and a cam surface (62) on the other thereof.

11. Apparatus as claimed in claim 10 wherein said cam follower (58) is supported on said transfer arm means (18).

12. Apparatus as claimed in claim 10 wherein said cam follower (58) and said cam surface (62) are cooperable to extend said transfer arm means (18) as the latter moves into said transfer station (20) and to enable retraction of said transfer arm means (18) as the latter moves out of said transfer station (20).

13. Apparatus as claimed in claim 12 further comprising selection means (64, 70) for enabling extension of preselected ones of said transfer arm means (18) during movement of said transfer arm means through said transfer station (20).

14. Apparatus as claimed in claim 13 wherein said selection means (64, 70) includes guide means (64) movable between first and second positions wherein, in said first position said guide means guides said cam follower (58) onto said cam surface (62) and in said second position said guide means (64) guides said cam follower (58) onto a second cam surface (62) to retain said transfer arm means (18) in said retracted position.

15. Apparatus as claimed in claim 14 wherein said selection means further comprises control means for controlling actuation of said guide means (64), said control means being operable to switch said guide means (64) between said first and second positions in dependence on the presence or absence of a pair of stockings on said support means.

16. Apparatus as claimed in claim 14 wherein said carousel unit is rotatable to move said transfer arm means (18) successively through a loading station and two transfer stations (20) for loading respective line closing machines at said transfer stations, and wherein said selection means comprising control means for controlling actuation of respective guide means (64) at each said transfer station (20), said control means being operable to switch each said guide means (64) between said first and second positions to cause extension of successive, even numbered transfer arm means (18) at said first transfer station (20) and to cause extension of successive odd numbered, transfer arm means (18) at said second transfer station (20).

17. Apparatus as claimed in claim 1 further comprising means for resiliently biasing each said transfer arms means (18) towards a retracted position.

* * * * *